US008562170B2

(12) United States Patent
Sohn

(10) Patent No.: US 8,562,170 B2
(45) **Date of Patent: *Oct. 22, 2013**

(54) LIGHT EMITTER TO BE ATTACHED TO CAPS

(76) Inventor: Dae Up Sohn, Seoul (KR)

( * ) Notice: Subject to any disclaimer, the term of this patent is extended or adjusted under 35 U.S.C. 154(b) by 167 days.

This patent is subject to a terminal disclaimer.

(21) Appl. No.: 12/864,661

(22) PCT Filed: Jan. 23, 2009

(86) PCT No.: PCT/KR2009/000383

§ 371 (c)(1),
(2), (4) Date: Jul. 26, 2010

(87) PCT Pub. No.: WO2009/093874

PCT Pub. Date: Jul. 30, 2009

(65) Prior Publication Data

US 2010/0309655 A1 Dec. 9, 2010

(30) Foreign Application Priority Data

Jan. 24, 2008 (KR) ..... 10-2008-0007630
Nov. 20, 2008 (KR) ..... 10-2008-0115580

(51) Int. Cl.
*F21L 2/00* (2006.01)
*F21L 4/00* (2006.01)

(52) U.S. Cl.
USPC ..... 362/191; 362/157; 362/190

(58) Field of Classification Search
None
See application file for complete search history.

(56) References Cited

U.S. PATENT DOCUMENTS 7,427,149 B2 * 9/2008 Sohn ..... 362/374
8,002,437 B2 * 8/2011 Sohn ..... 362/249.09
2005/0128737 A1 6/2005 Pare'
2007/0109768 A1 5/2007 Sohn

FOREIGN PATENT DOCUMENTS

JP 2004-311188 11/2004
WO 2005-077215 8/2005

OTHER PUBLICATIONS

International Search Report for PCT/KR2009/000383 mailed Sep. 10, 2009.
Written Opinion of the International Searching Authority for PCT/KR2009/000383 mailed Sep. 10, 2009.

* cited by examiner

*Primary Examiner* — Natalie Walford
(74) *Attorney, Agent, or Firm* — Christopher Paul Mitchell

(57) ABSTRACT

Disclosed is a light emitter to be attached to caps. The light emitter includes a case having a plurality of second lamps (22) formed at a front surface thereof, a power switch attached to an outer surface of the case, a battery installed inside the case to provide power, a guide groove formed at a center of the case, a mounting clip formed at the outer surface of the case, a sub-body having a lamp at a front surface thereof and being coupled to the guide groove, and switch unit for controlling on/off operation of the lamp. The user freely adjusts the distance of radiant light, amount of radiant light and radiation angle of the lamp. The light emitter is fixed to a pocket to radiate light in the forward direction by arranging the sub-body at a right angle with respect to a case.

39 Claims, 15 Drawing Sheets

LIGHT EMITTER TO BE ATTACHED TO CAPS

RELATED APPLICATION

This application is 371 application of International Application No. PCT/KR2009/000383, filed Jan. 23, 2009, which in turn claims priority from Korean Patent Application Nos. 10-2008-0115580, filed Nov. 20, 2008, and 10-2008-0007630, filed Jan. 24, 2008, all of which are incorporated herein by reference in their entireties.

TECHNICAL FIELD

The present invention relates to a light emitter to be attached to caps. More particularly, the present invention relates to a light emitter to be attached to caps, in which the light emitter is detachably installed on a visor of the cap to provide a visual field to a user.

BACKGROUND ART

In general, a user puts on a cap to protect the face from sunlight and prevent sweat from running down to the face when climbing mountains or fishing.

If a light emitting device is mounted on a visor of the cap, two hands are set free, so that activity of the user is improved. In addition, radiation direction of the light emitting device matches with the sight line, so the user can easily obtain a visual field.

In order to utilize such advantages, applicant of the present invention has filed "a light emitter to be attached to caps", Korean Utility Model Registration No. 0312151, which corresponds to U.S. Pat. Nos. 7,118,241 and 7,163,309, and Canadian Patent No. 2,535,295.

FIG. 1 is a view representing a light emitter according to the related art.

As shown in FIG. 1, a light emitter to be attached to caps includes a case 22 forming a body, a plurality of lamps 24 installed at a front side of the case 22 while being spaced apart from each other, a switch member 26 installed at a side of the case 22, a clip 28, which is integrally coupled with the case 22 to have elasticity, and a battery accommodated in the case 22.

However, according to the related art, since the lamps installed at the front side of the case are simultaneously turned on or off by a single switch member, the light emitter has a difficulty in adjusting the distance or amount of radiant light, or in saving the battery.

Also, when the light emitter to be attached to caps is carried in a knapsack or a pocket, the switch can be turned on regardless of the intention of a user. In this case, the lamps may be turned on simultaneously, so that the battery may be rapidly discharged in contrast with user's intention.

In addition, since all of the lamps are fixedly directed in the forward direction, if the user wants to change the radiation direction, the user must turn the head of the user to the intended direction.

Furthermore, in the case of a short range radiation, a small quantity of radiation is required as compared with that of a long range radiation. However, the conventional light emitter can not adjust the amount of radiant light according to the radiation range.

DISCLOSURE OF INVENTION

Technical Problem

The present invention has been made to solve the above problem occurring in the prior art, and an object of the present invention is to provide a light emitter to be attached to caps, which is an improvement of Korean Utility Model Registration No. 0312151. According to the light emitter of the present invention, some of a plurality of lamps are independently turned on/off through back and forth movement, and an angle of the individual lamp can be adjusted such that the radiation direction of the lamp can be changed in upper and lower directions, and the amount of radiant light can be changed by adjusting the angle, thereby ensuring convenience of the user.

In addition, another object of the present invention is to provide a light emitter to be attached to caps, in which some lamps, which are independently adjusted, are set to have a strong luminosity as compared with that of the remaining lamps so that the user can utilize the lamps with various combinations while saving the battery.

Still another object of the present invention is to provide a light emitter to be attached to caps, in which an additional switch unit is provided to prevent a battery from being unintentionally discharged even if a power switch is turned on by mistake.

Still yet another object of the present invention is to provide a light emitter to be attached to caps, in which an auxiliary battery is provided at the lamp equipped with the additional switch unit such that the lamp can be operated regardless of the discharge state of a main battery.

Still yet another object of the present invention is to provide a light emitter to be attached to caps, in which the light emitter can be fixed to a shirts pocket of the user to radiate light in the front direction when some lamps, which are independently adjusted, are arranged at a right angle.

Technical Solution

The foregoing and/or other aspects of the present invention are achieved by providing a light emitter including a case having a plurality of second lamps formed at a front surface thereof, a power switch attached to an outer surface of the case, a battery installed inside the case to provide power, a guide groove formed at a center of the case, a mounting clip formed at the outer surface of the case, and a sub-body having a lamp at a front surface thereof and being coupled to the guide groove to move back and forth or rotate, and a switch unit, which allows the lamp to be turned on upon a forward movement of the sub-body and turned off upon a backward movement of the sub-body.

Advantageous Effects

As described above, according to the present invention, the user can adjust the distance of radiant light and the amount of radiant light by moving a sub-body equipped with a first lamp back and forth such that the first lamp is independently turned on. In addition, the sub-body is rotated such that the user can adjust the radiation angle without moving the head of the user. If the sub-body is arranged at a right angle with respect to a case, the light emitter can be fixed to a shirts pocket or a belt to radiate light in the forward direction, thereby ensuring convenience of the user.

In addition, the light emitter provides a complex function, in which the light is turned on/off in a forward direction as a rescue signal and irradiated downward the pedestrian's foot to help safety walking.

In addition, an additional switch unit for a first lamp is provided such that the user can adjust the amount of battery consumption.

BRIEF DESCRIPTION OF DRAWINGS

FIGS. 6 to 9 are enlarged views representing a switch unit applied to the second embodiment of the present invention, wherein FIG. 6 represents a state in which a sub-body moves backward, FIG. 7 represents a state in which the sub-body moves forward, FIG. 8 represents a state in which the sub-body rotates downward by a predetermined angle, and FIG. 9 represents a state in which the sub-body rotates into an upright position;

BEST MODE FOR CARRYING OUT THE INVENTION

Hereinafter, preferred embodiments of the present invention will be described in detail with reference to the accompanying drawings.

Embodiment 1

Figure 1:
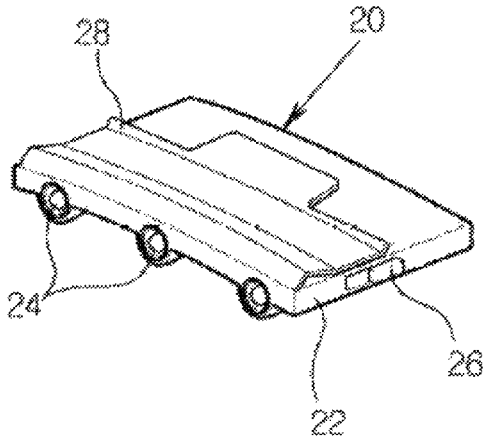
FIG. 1 is view representing a light emitter according to the related art.
Figure 2:
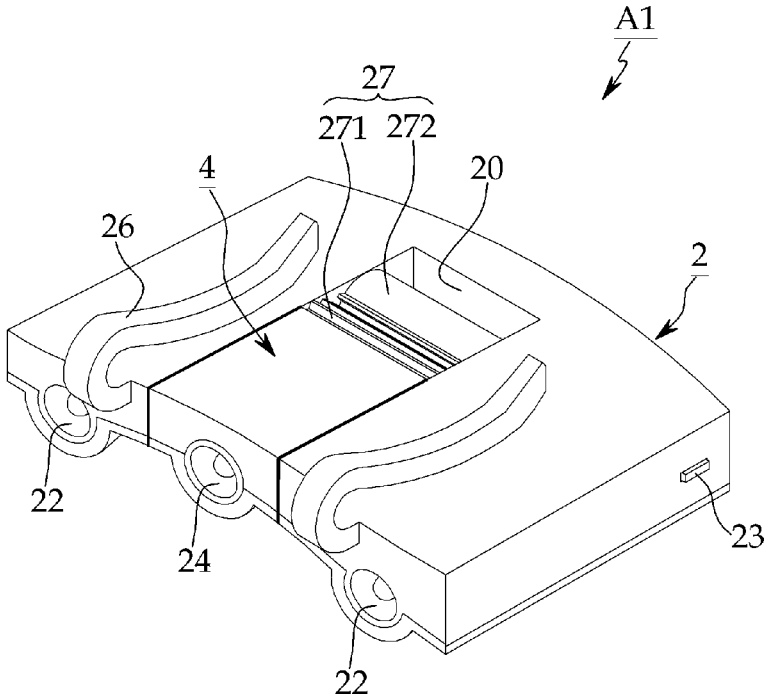
FIG. 2 is a perspective view representing a light emitter to be attached caps according to the first embodiment of the present invention.
Figure 3:
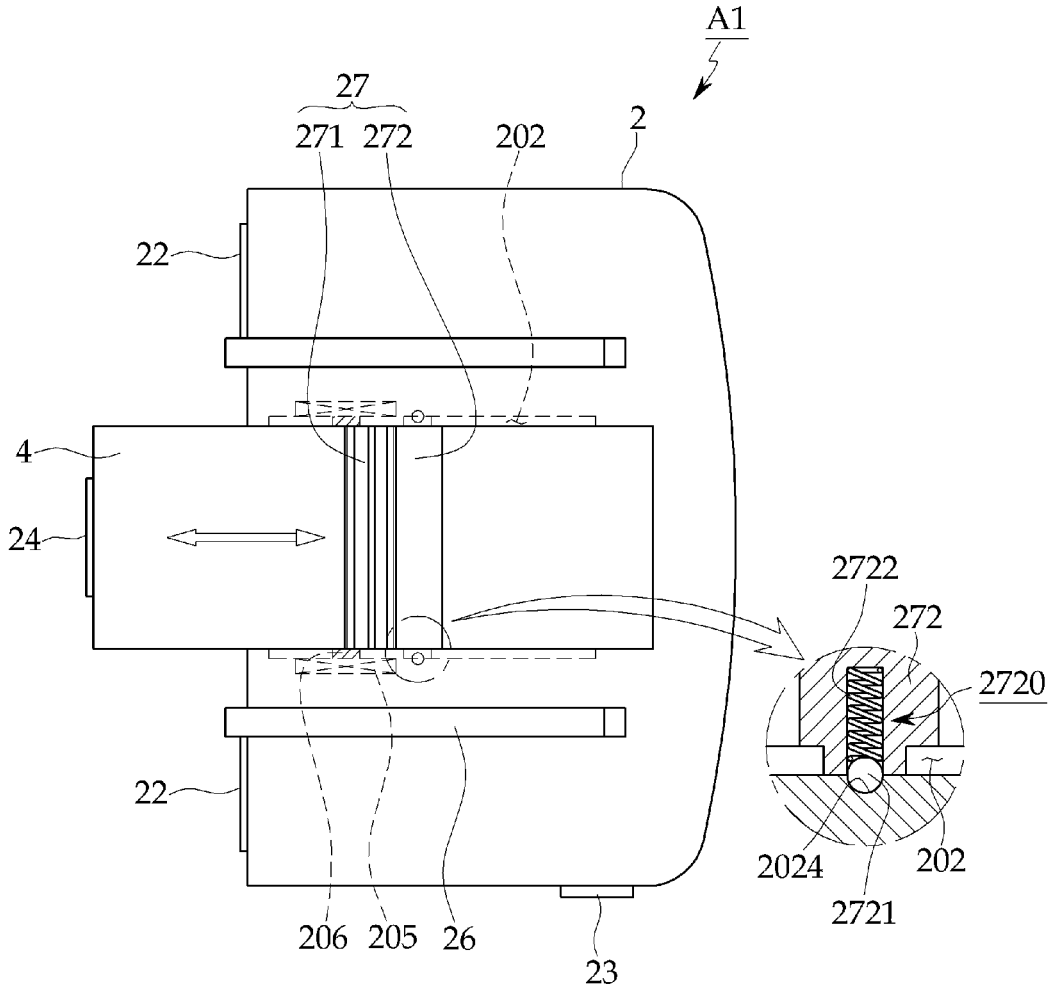
FIG. 3 is a plan view representing the light emitter to be attached to the cap according to the first embodiment of the present invention.
Figure 4:
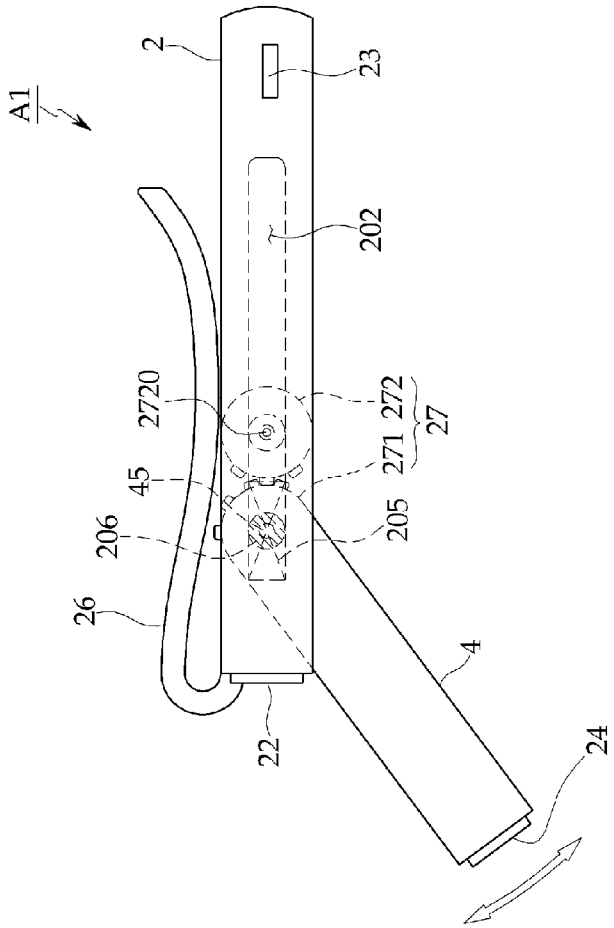
FIG. 4 is a side view representing the light emitter to be attached to the cap according to the first embodiment of the present invention.

FIG. 2 is a perspective view representing a light emitter to be attached to caps according to a first embodiment of the present invention, FIG. 3 is a plan view representing the light emitter to be attached to the cap according to the first embodiment of the present invention, and FIG. 4 is a side view representing the light emitter to be attached to the cap according to the first embodiment of the present invention.

As shown in FIGS. 2 to 4, a light emitter A1 to be attached to caps according to a first embodiment of the present invention includes a case 2 having a plurality of second lamps 22 formed at a front surface thereof, a power switch 23 attached to an outer surface of the case 2, a battery installed inside the case 2 to provide power, a guide groove 20 formed at a center of the case 2, and a mounting clip 26 formed at the upper surface of the case 2, a sub-body 4 having a first lamp 24 at a front surface thereof and being coupled to the guide groove 20 to move back and forth or rotate, and a switch unit for controlling on/off operation of the first lamp 24.

Hereinafter, the elements of the light emitter A1 will be described in more detail.

As shown in FIG. 2, the case 2 has the clip 26 formed at an upper surface of the case 2, the guide groove 20 formed at the front middle part of the case 2 and extending inward of the case 2 by a predetermined length, the second lamps 22 formed at both sides of the guide groove 20 at the front surface of the case 2, the battery mounted inside the case 2 to provide power, and the power switch 23 formed at an outer surface of the case 2.

The guide groove 20 is formed by slitting the middle part of the case 2 inward of the case 2. A rail groove 202 is formed lengthwise along inner both sides of the guide groove 20.

For convenience sake, the guide groove 20 is illustrated to be seen from the outside in the drawings. However, preferably, a cover surface may be formed on an upper part of the guide groove 20 in the same plane with the upper surface of the case 2.

The sub-body 4 has the first lamp 24 formed at the front surface thereof, and slides back and forth or rotates in a state in which the sub-body 4 is inserted into the guide groove 20.

The forward movement of the sub-body 4 represents that the sub-body 4 is pulled out of the case 2 and the backward movement of the sub-body 4 represents that the sub-body 4 is inserted into the case 2.

According to an example of a structure enabling the sliding movement of the sub-body 4 back and forth, as shown in FIGS. 3 and 4, the rail groove 202 is formed at a side surface of the guide groove 20, and a projection 45 is formed on the sub-body 4 such that the sub-body 4 slides back and forth in a state in which the projection 45 is coupled to the rail groove 202.

According to another embodiment, a cover surface extending from upper/lower surfaces of the case 2 is formed such that the sub-body 4 is inserted into the case 2. In this case, the rail groove 202 can be formed on the cover surface other than the side surface of the guide groove 20, and the projection 45 corresponding to the rail groove 202 is formed at upper/lower surfaces of the sub-body 4. Various modifications for the back/forth movement structure may be apparent to those skilled in the art.

A structure for rotating the sub-body 4 will be described later.

The switch unit allows the first lamp 24 to be turned on upon the forward movement of the sub-body 4 and to be turned off upon the backward movement of the sub-body 4.

As shown in FIGS. 3 and 4, as an example, the switch unit includes a first contact point 205 installed at a front side of the rail groove 202 and a second contact point 206 formed at an outer circumference of the projection 45 of the sub-body 4.

That is, when the sub-body 4 moves forward, the second contact point 206 makes contact with the first contact point 205, so that power is provided, thereby turning on the first lamp 24. In addition, when the sub-body 4 moves backward, the second contact point 206 is separated from the first contact point 205, so that the first lamp 24 is turned off.

On the contrary, the switch unit can be set such that the first lamp 24 is turned off upon the forward movement of the sub-body 4 and turned on upon the backward movement of the sub-body 4. That is, the first contact point 205 may be installed at a rear side of the rail groove 202 such that the first contact point 205 and the second contact point 206 make contact with each other and the first lamp 24 is turned on when the sub-body 4 moves backward. Otherwise, the contact points may be installed corresponding to a rear side of the sub-body 4 and the guide groove 20.

Meanwhile, the sub-body 4 is provided with a rotation part 27 such that the sub-body 4 is rotated by the rotation part 27 to adjust the angle of the sub-body 4.

That is, in a state in which the first lamp 24 is turned on upon the forward or backward movement of the sub-body 4, the sub-body 4 rotates downward to irradiate light downward, so that a user can easily view a substance positioned within a short distance.

As shown in FIGS. 2 and 4, as an example, the rotation part 27 includes a first gear 271 formed at a rear side of the sub-body 4 and a second gear 272 engaged with the first gear 271.

Meanwhile, the sub-body 4 further includes a fixing member 2720 configured to maintain an advanced state of the sub-body 4.

As shown in FIG. 3, the fixing member 2720 includes a protruding member formed at both sides of the second gear 272 and a recess 2024 formed at front both sides of the guide groove 20 corresponding to the protruding member.

Preferably, the recess 2024 is formed inside the rail groove 202.

In detail, the protruding member includes a iron ball 2721 buried at an end of a shaft rod formed at both sides of the second gear 272 and a spring 2722 installed to elastically support the iron ball 2721.

Accordingly, if the sub-body 4 moves forward, the second gear 272 moves forward in cooperation with the sub-body 4, and the protruding member is inserted into the recess 2024, so that the sub-body 4 is fixed in the advanced state.

In addition, in the fixing member 2720 according to another embodiment, the recess 2024 can be additionally provided at rear both sides of the guide groove 20 such that fixing strength is applied in a state in which the sub-body 4 moves backward.

However, the position of the protruding member and the recess 2024 of the fixing member 2720 is not limited to the both sides of the second gear 272 and the rail groove 202 as described in the present embodiment, but can be modified according to the intention of a designer.

Meanwhile, the rotation part 27 further includes a brightness adjustment member (not shown) such that brightness of the first lamp 24 can be adjusted according to the rotation angle of the sub-body 4.

Preferably, the brightness adjustment member allows the first lamp 24 to have a low brightness upon downward rotation of the sub-body 4 and have a high brightness upon upward rotation of the sub-body 4.

That is, since the sub-body 4 is rotated downward for a short distance radiation, strong brightness is not necessary. Also, since the sub-body 4 is rotated upward for a long distance radiation, strong brightness is needed such that fatigue of the eyes of the user is relieved in the long distance radiation.

Since the brightness adjustment member is generally known in the art, the detailed description of the brightness adjustment member will be omitted. However, the brightness adjustment can be achieved by fabricating the rotation part 27 having a multi-contact point structure, and the brightness adjustment mechanism will be described in detail by a second embodiment.

In addition, the first lamp 24 uses a high brightness LED brighter than the second lamp 22. Accordingly, the lamps are selectively used according to surrounding situations.

Meanwhile, in case that the battery is discharged, an auxiliary battery is accommodated in the sub-body 4 or an auxiliary switch is installed on the sub-body 4. Otherwise, an auxiliary battery for the first lamp 24 is accommodated in the case 2.

Accordingly, even when the second lamp 22 is not turned on due to discharge of the battery, the first lamp 24 of the sub-body 4 can emit light by the auxiliary battery.

Hereinafter, a coupling structure and an operation of the light emitter A1 described above will be explained.

The sub-body 4 is inserted into the guide groove 20 of the case 2 such that the projection 45 is coupled into the rail groove 202.

After that, the battery is installed in the case 2.

The light emitter A1 coupled as described above is coupled to a visor of the cap using the clip 26.

After that, if the power switch 23 is switched on, the second lamp 22 is turned on, but the first lamp 24 is turned off.

If the sub-body 4 moves forward to turn on the first lamp 24, the first and second contact points 205 and 206 make contact with each other, so that the first lamp 24 is turned on.

Otherwise, as described above, the light emitter A1 is fabricated such that the first lamp 24 is turned on when the sub-body 4 moves backward. Such an on/off operation is selectively applied to the light emitter A1 according to the intention of user. The battery life can be extended through such an operation.

After that, the sub-body 4 is rotated by the user to set a proper radiation angle.

In this case, if the sub-body 4 is rotated downward, brightness of the first lamp 24 is lowered, and if the sub-body 4 is rotated upward, brightness of the first lamp 24 becomes high.

The light emitter A1 can be operated in contrary to the operation described above according to the intention of user, or the light emitter A1 can be operated at a constant brightness.

As a result, even if the power switch 23 is unintentionally switched on when the light emitter A1 is carried in the pocket, the second lamp 22 is turned on, but the first lamp 24 is turned off. Accordingly, discharge of the battery is delayed, so the user can check the battery before the battery is completely discharged.

Accordingly, the battery is prevented from being completely discharged, so that lightening function of the light emitter A1 is maintained. In particular, since the auxiliary battery for the sub-body 4 is provided in the light emitter A1, even if the brightness of the second lamp 22 is rather lowered, the function of the first lamp 24 can be maintained, thereby ensuring the lightening function.

MODE FOR THE INVENTION

Embodiment 2

Figure 5:
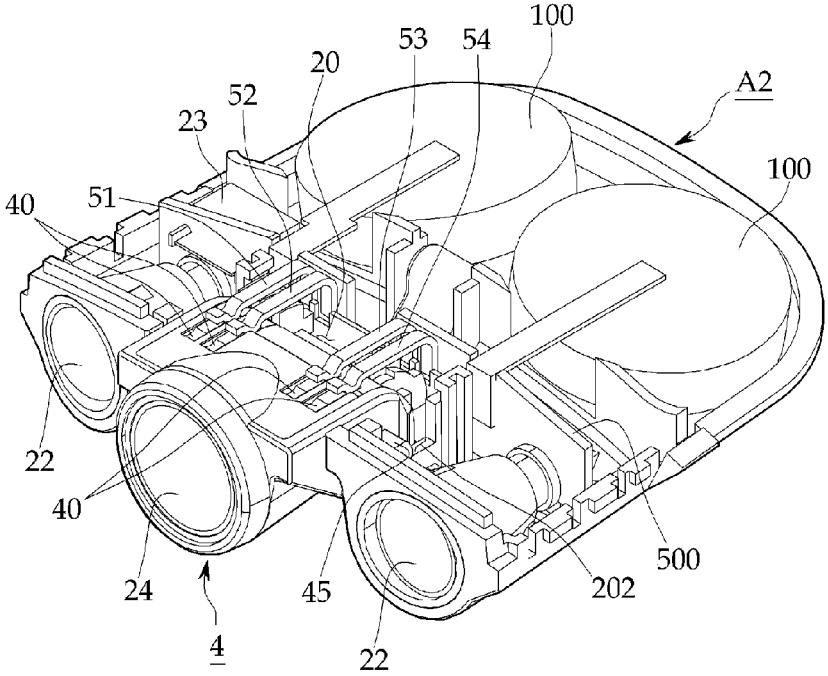
FIG. 5 is an exploded perspective view representing a light emitter to be attached to caps according to a second embodiment of the present invention.

Meanwhile, FIG. 5 is an exploded view representing a light emitter A2 to be attached to caps according to a second embodiment of the present invention.

Figure 6:
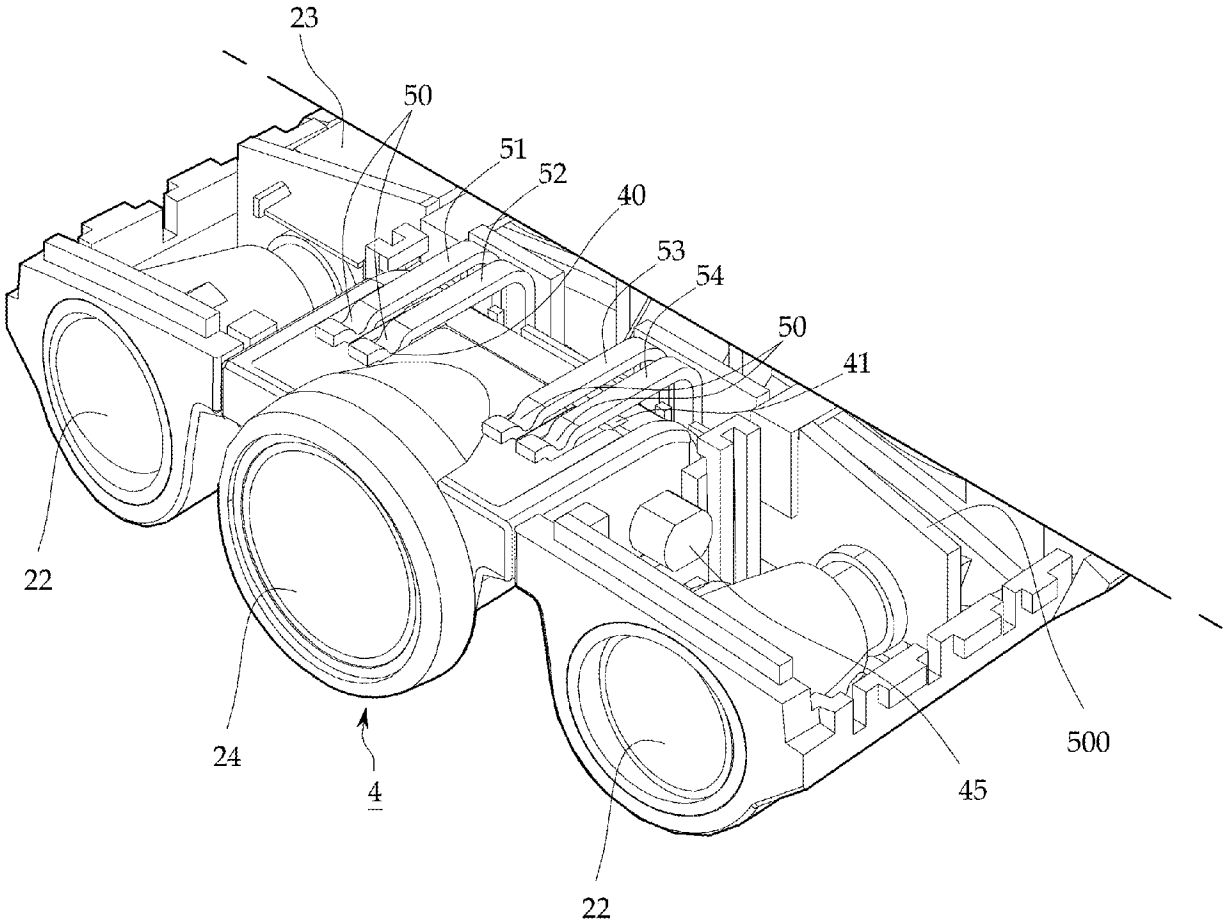
Figure 7:
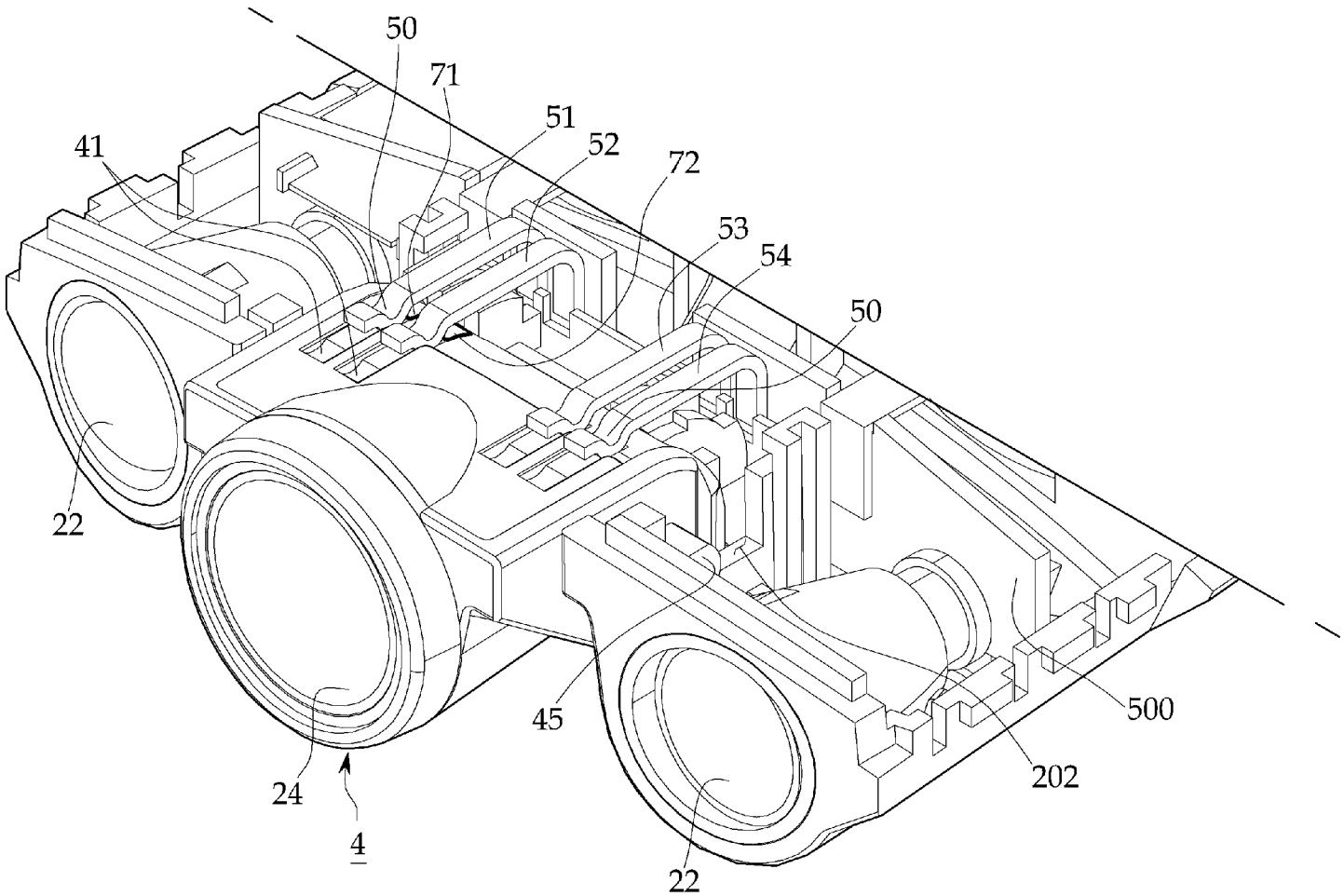
Figure 8:
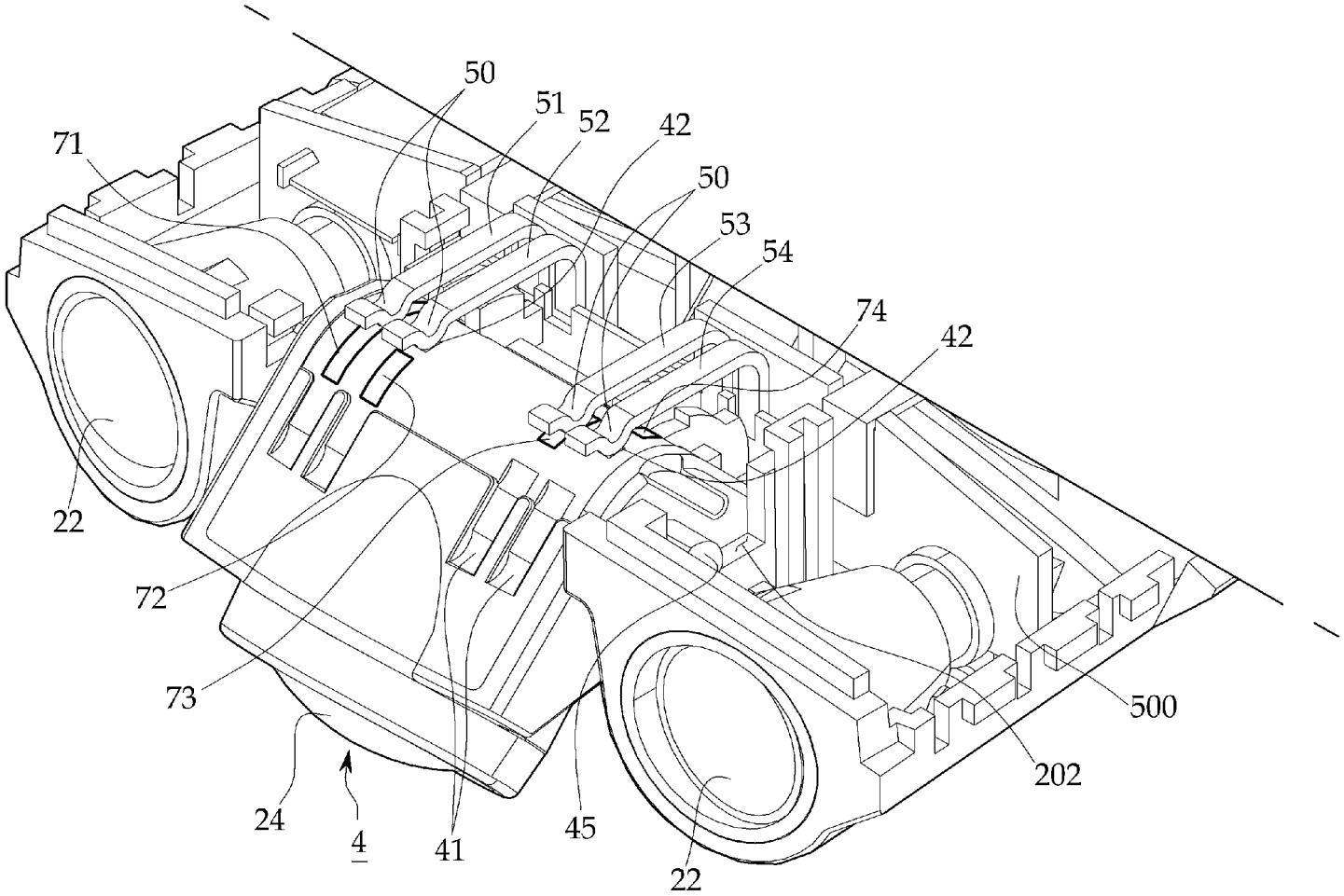
Figure 9:
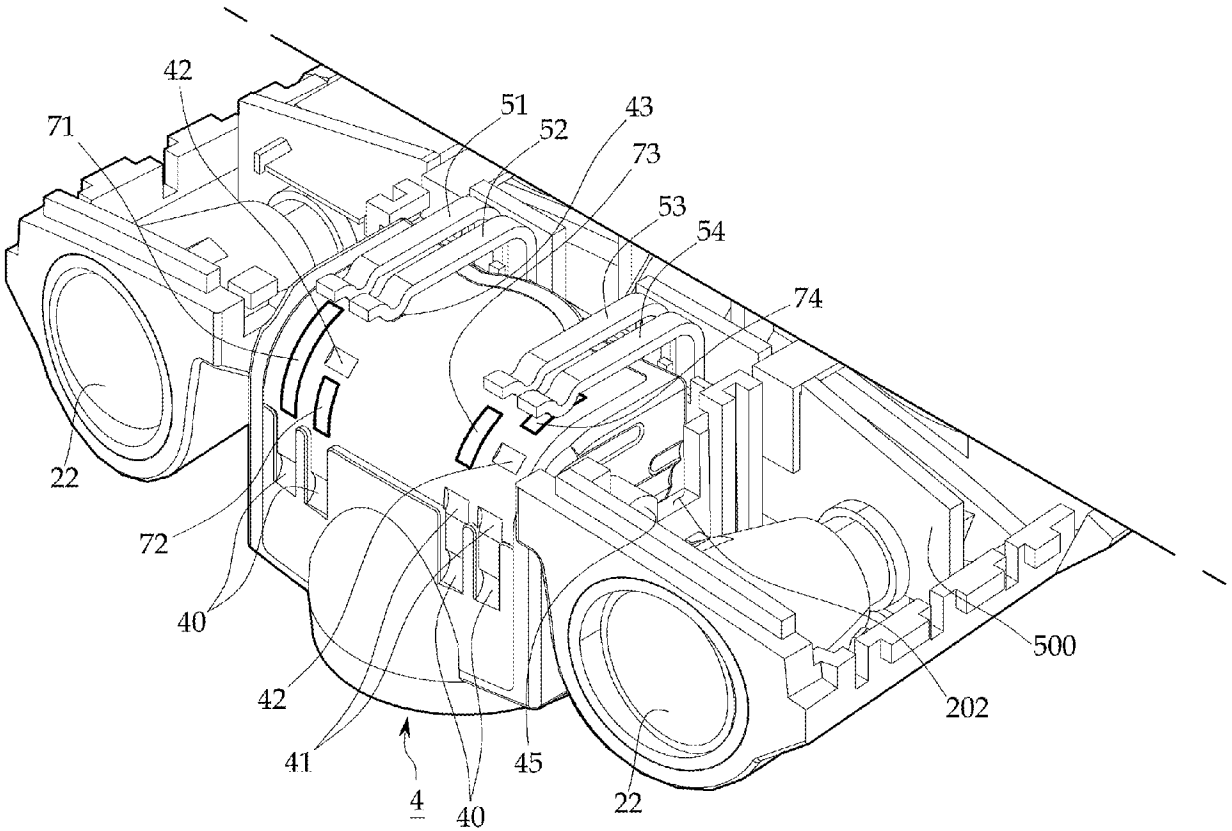

FIGS. 6 to 9 are enlarged views representing a switch unit used in the second embodiment of the present invention, FIG. 6 represents a state in which the sub-body moves backward, FIG. 7 represents a state in which the sub-body moves forward, FIG. 8 represents a state in which the sub-body rotates downward by a predetermined angle, and FIG. 9 represents a state in which the sub-body rotates into upright position.

As shown in FIGS. 5 to 9, the switch unit according to the second embodiment includes a positive terminal 51 and first to third negative terminals 52 to 54, which are formed on a main electrode plate 500 electrically connected to a battery 100, and a negative plate 71 and first to third positive plates 72 to 74 that are formed on the sub-body 4 and make contact with the positive terminal 51 and the first to third negative terminals 52 to 54, respectively.

The positive terminal 51 and the first to third negative terminals 52 to 54 are formed in a cantilever type on the main electrode plate 500, which is connected to the battery 100, to be supported by an outer surface of the sub-body 4.

The negative plate 71 and the first to third positive plates 72 to 74 have a band shape. Preferably, the negative plate 71 is formed at the rear side of the sub-body 4 in a length longer than that of the first to third positive plates 72 to 74.

In particular, the negative plate 71 has a shape corresponding to the positive terminal 51, and the first to third positive plates 72 to 74 have a shape corresponding to the first to third negative terminals 52 to 54.

Accordingly, when the sub-body 4 is pulled forward, the negative plate 71 makes contact with the positive terminal 51, and the first positive plate 72 makes contact with the first negative terminal 52 to provide power, so that the first lamp 24 is turned on.

In contrary, when the sub-body 4 moves backward, the negative plate 71 and the first positive plate 72 are separated from the positive terminal 51 and the first negative terminal 52, respectively, so that the first lamp 24 is turned off.

Meanwhile, as shown in FIGS. 6 to 9, the rotation part according to another embodiment includes a groove formed at a rear side of the sub-body 4 and elastic protrusions 50 inserted into the groove.

The groove includes a first groove 41, a second groove 42 and a third groove 43 that are formed at a rear end of the sub-body 4 to set a rotation angle.

The elastic protrusion 50 is inserted into a fixing groove 40 and the first to third grooves 41 to 43 to fix a position of the rotation part.

A curved surface part having an arc shape is formed at the rear end of the sub-body 4.

As shown in FIG. 8, the first groove 41 is formed on an upper horizontal surface of the sub-body 4 at the rear side of the sub-body 4 corresponding to the second and third negative terminals 53 and 54.

As shown in FIG. 8, a plurality of fixing grooves 40 are formed at a front side of the first groove 41 such that the elastic protrusion 50 is inserted into the fixing groove to maintain a state in which the sub-body 4 moves backward.

The fixing grooves 40 are formed on a position corresponding to the positive terminal 51 and the first to third negative terminals 52 to 54.

As shown in FIG. 9, the second groove 42 is formed on a part in which the upper horizontal surface and the rear curved surface part of the sub-body 4 are connected to each other. In particular, the second groove 42 is formed on a position corresponding to the first and third negative terminals 52 and 54.

As shown in FIG. 9, the third groove 43 is formed in the center of the rear curved surface part on a position corresponding to the first and second negative terminals 52 and 53.

The elastic protrusion 50 according to the present embodiment is formed by bending an end of the positive terminal 51 and the first to third negative terminals 52 to 54 downward.

However, the structure of the elastic protrusion 50 is not limited to the present embodiment. The elastic protrusion 50 and the grooves 40 to 43 according to another embodiment can be additionally formed in the guide groove 20.

Hereinafter, the operation of the sub-body 4 will be described.

As shown in FIG. 6, if the sub-body 4 moves backward, the elastic protrusions 50 of the positive terminal 51 and the first to third negative terminals 52 to 54 are fixedly inserted into the fixing groove 40. At this time, the first lamp 24 represents a turn-off state.

After that, as shown in FIG. 7, the sub-body 4 moves forward such that the elastic protrusions 50 of the second and third negative terminals 53 and 54 are fixedly inserted into the first groove 41.

Therefore, the positive terminal 51 makes contact with the negative plate 71 and the first negative terminal 52 makes contact with the first positive plate 72 to provide the first lamp 24 with power, so that the first lamp 24 is turned on.

As shown in FIG. 8, if the sub-body 4 is rotated downward by a predetermined angle, the elastic protrusions 50 of the first negative terminal 52 and the third negative terminal 54 are inserted into the second groove 42, thereby fixing the rotated state of the sub-body 4.

In this condition, the positive terminal 51 is still in contact with the negative plate 71, and the second negative terminal 53 comes into contact with the second positive plate 73 to provide power for the first lamp 24, thereby turning on the first lamp 24.

After that, as shown in FIG. 9, the sub-body 4 further rotates to form an upright state, so that the elastic protrusions 50 of the first and second negative terminals 52 and 53 are fixedly inserted into the third groove 43.

At this time, the positive terminal 51 is still in contact with the negative plate 71, and the third negative terminal 54 makes contact with the third positive plate 74 to provide the first lamp 24 with power, so that the first lamp 24 is turned on.

The number of grooves formed in the sub-body 4 and the setting angle of the grooves can be changed according to the embodiments.

The brightness of the first lamp 24 according to the second embodiment can be changed corresponding to the rotation angle of the sub-body 4 similarly to the first embodiment. The brightness can be adjusted by adopting a multi-point structure.

In detail, as described above, a plurality of terminals and electrode plates are provided on the sub-body 4 such that a plurality of contact points are connected to a printed circuit board (not shown) installed in the light emitter A2. In this case, a circuit of the printed circuit board can be designed such that different amount of current can be applied to the contact points, respectively. Thus, the brightness can be changed depending on the connection state of the contact points with respect to the circuit caused by the rotation of the sub-body 4.

Preferably, as shown in FIG. 6, in the case that the sub-body 4 is horizontally withdrawn, the first lamp 24 has the strongest luminosity.

As shown in FIG. 7, in the case that the sub-body 4 is slantingly rotated, the first lamp 24 emits light at relatively weak intensity.

As shown in FIG. 8, in the case that the sub-body 4 is rotated in the upright state, the first lamp 24 emits light at the weakest intensity.

The above embodiments have illustrative purposes, and the present invention is not limited thereto. The adjustment of the brightness can be modified in various forms.

Embodiment 3

Figure 10:
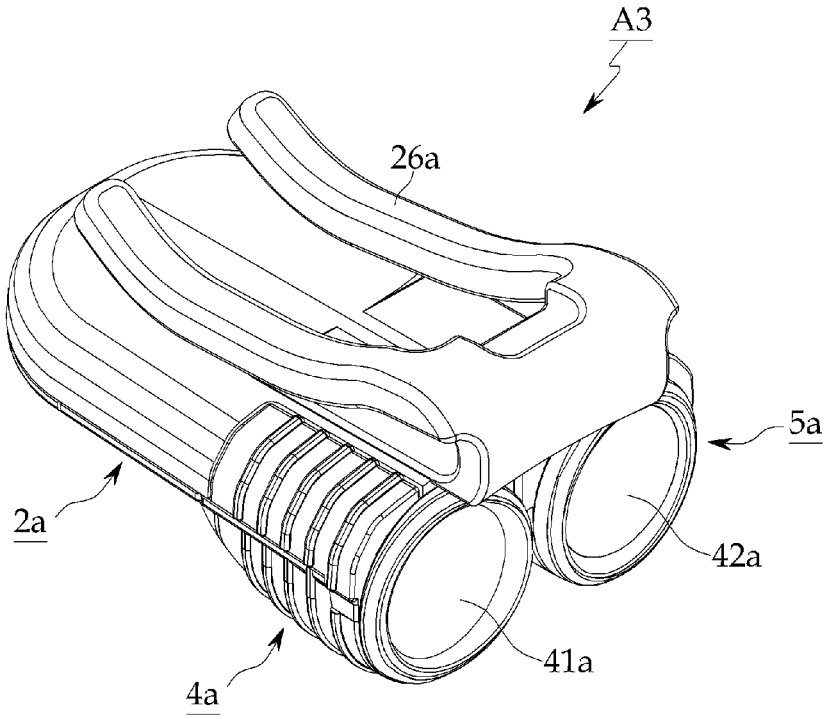
FIG. 10 is a perspective view representing a light emitter to be attached to caps according to the third embodiment of the present invention.
Figure 11:
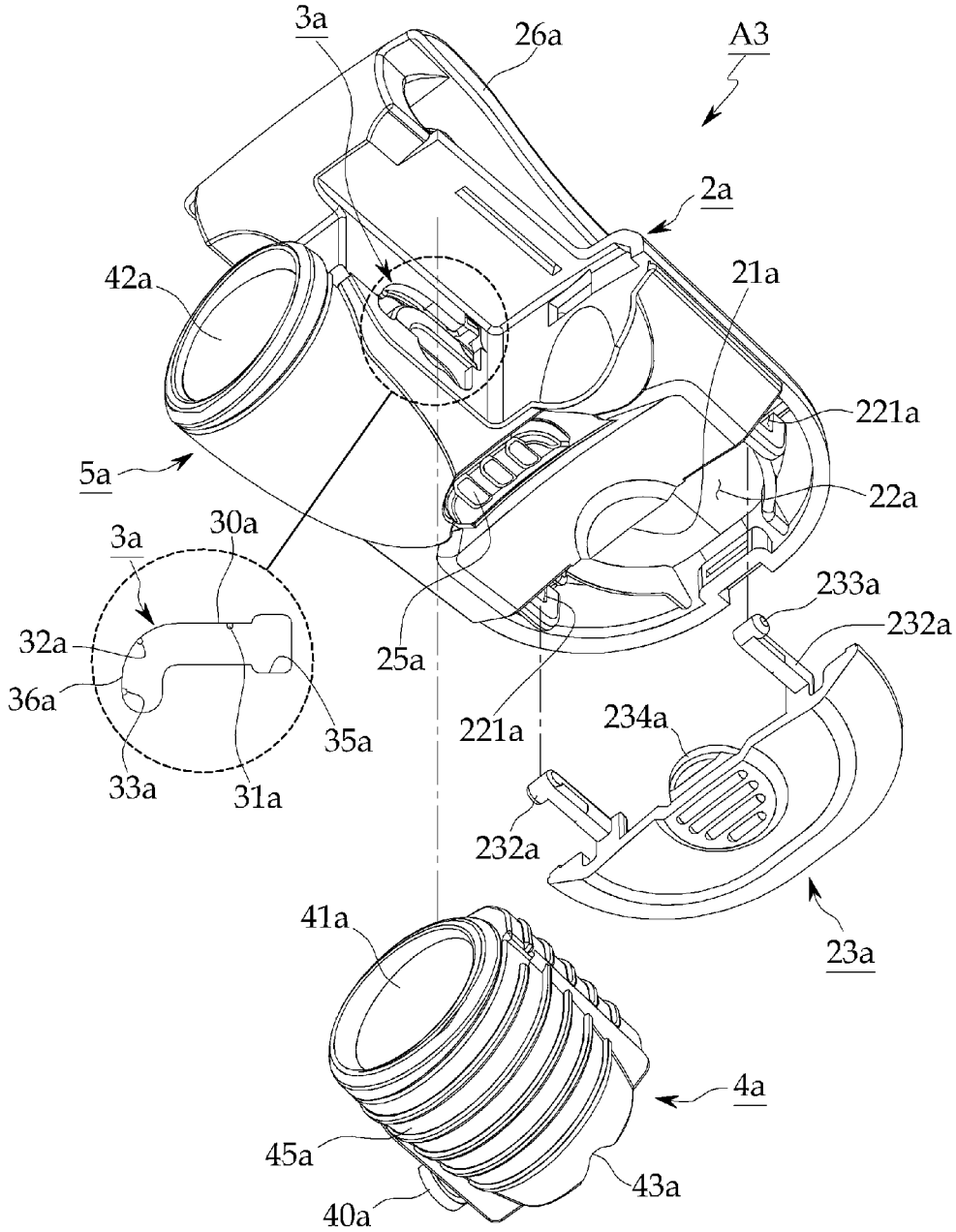
FIG. 11 is a bottom exploded perspective view of the light emitter to be attached to the cap according to the third embodiment of the present invention.
Figure 12:
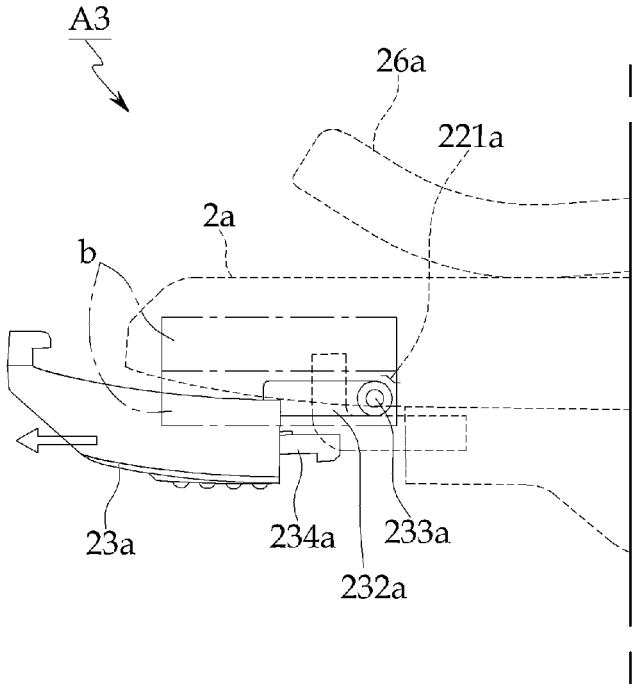
FIGS. 12 and 13 are side views representing a battery cover being separated from a light emitter according to the third embodiment of the present invention.
Figure 13:
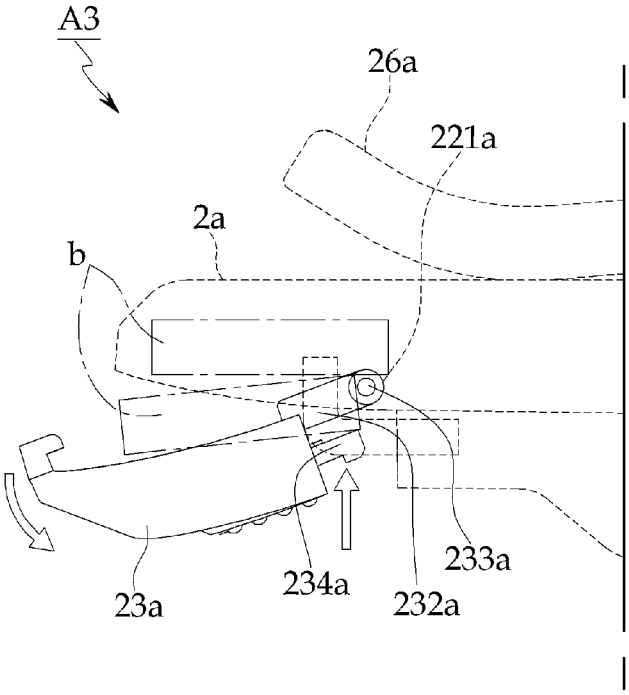

FIG. 10 is a perspective view representing a light emitter to be attached to caps according to the third embodiment of the present invention, FIG. 11 is a bottom exploded perspective view of the light emitter to be attached to the caps according to the third embodiment of the present invention, and FIGS. 12 and 13 are side views representing a battery cover being separated from the light emitter according to the third embodiment of the present invention.

As shown in FIGS. 10 to 11, the light emitter A3 to be attached to the caps according to the third embodiment of the present invention includes a case 2*a* and a sub-body 4*a*. The case 2*a* has a fixed lighting part 5*a*, which is formed at a front side of the case 2*a* and is equipped with a second lamp 42*a*, a power switch 25*a* formed at an outer surface of the case 2*a*, a power supply part formed at a rear side of the case 2*a* to provide power, and a mounting clip 26*a* formed at the outer surface of the case 2*a*. The sub-body 4*a* is provided with a first lamp 41*a* and is coupled to a side of the fixed lighting part 5*a*. The sub-body 4*a* moves back and forth to turn on/off the first lamp 41*a* and is rotated.

The power switch 25*a* is installed at a lower part of the case 2*a* to control on/off operations of the fixed lighting part 5*a*.

The first and second lamps 41*a* and 42*a* include LEDs, and may have brightness different from each other.

The sub-body 4*a* is formed at a side thereof with a rotation part such that an angle of the sub-body 4*a* is adjusted. The rotation part includes a guide groove 3*a* formed in the case 2*a* and a projection 40*a*, which is formed at a side of the sub-body 4*a* and is coupled to the guide groove 3*a* such that the sub-body 4*a* is rotated.

The guide groove 3*a* includes a horizontal part 30*a* having a predetermined length and a curved part 36*a*, which is connected to the horizontal part 30*a* and is bent in an arc-shape. A recess 35*a* is further formed at a lower part of the horizontal part 30*a* such that the projection 40*a* is locked with the recess 35*a*.

In addition, a plurality of studs making contact with the projection 40*a* are formed in the guide groove 3*a* such that the sub-body 4*a* can be fixed at various angular positions. According to the present embodiment, three studs are provided. For convenience's sake, the three studs are referred to as first to third studs 31*a* to 33*a*, respectively.

The first stud 31*a* is formed on the horizontal part 30*a* to maintain a state in which the projection 40*a* is withdrawn from a recess 35*a* and then moves along the horizontal part 30*a*. The second stud 32*a* is formed in a middle of the curved part 36*a* to maintain a state in which the projection 40*a* rotates downward by about 45 degrees, and the third stud 33*a* is formed at an end of the curved part 36*a* to maintain a state in which the projection 40*a* rotates by 90 degrees.

A plurality of ring shaped concave-convex sections 45*a* are formed at an outer surface of the sub-body 4*a*. Thus, a user can easily catch the sub-body 4*a*, so that the sub-body 4*a* can be easily inserted and rotated.

In addition, an operation notch 43*a* having an arc shape is formed at a rear end of the sub-body 4*a* such that the user can easily put a nail tip in the operation notch.

Accordingly, in a state in which the light emitter according to the present invention is installed by mounting the clip 26*a* on the cap, the user can easily move the sub-body 4*a* forward by engaging the thumb nail of the user with the operation notch 43*a* and pushing the sub-body 4*a*. In addition, the user can easily adjust the rotation angle of the sub-body 4*a* by rotating the sub-body 4*a* using the ring shaped concave-convex section 45*a* and.

Similarly to the first embodiment, the light emitter A3 according to the third embodiment further includes a brightness adjustment member such that brightness of the first lamp 41*a* is adjusted according to the rotation angle of the sub-body 4*a*.

The brightness adjustment member is fabricated such that brightness of the first lamp 41*a* is lowered when the sub-body 4*a* is rotated downward, and brightness of the first lamp 41*a* becomes high if the sub-body 4*a* is rotated upward.

That is, since the sub-body 4*a* is rotated downward for a short distance radiation, strong brightness is not necessary. Also, since the sub-body 4*a* is rotated upward for a long distance radiation, strong brightness is needed such that fatigue of the eyes of the user is relieved in the long distance radiation.

The light emitter A3 can be operated in contrary to the operation described above according to the intention of user.

Since the brightness adjustment member and switch unit formed on the sub-body 4*a* have been described through the second embodiment, description thereof will be omitted in order to avoid redundancy.

As shown in FIGS. 11 to 13, the power supply part includes a battery accommodation part 22*a* formed at an inner rear side of the case 2*a* and a cover 23*a*, which is coupled to the battery accommodation part 22*a* and opens/closes the accommodation part 22*a* in such a manner that a battery b can be replaced without completely separating the battery accommodation part 22*a*.

The battery accommodation part 22*a* includes positive and negative contact terminals, which are formed at an inner upper part and an inner lower part of the battery accommodation part 22*a* and make contact with the battery b, respectively, and a joint slot 221 formed to couple the cover 23*a* to both sides of the battery accommodation part 22*a*.

The cover 23*a* has a plate shape and is large enough to cover the battery accommodation part 22*a*. A leading part 232*a* having a tip projection 233*a* is formed at front both ends of the cover 23*a* in a predetermined length. The tip-projection 233*a* of the leading part 232*a* is inserted into the joint slot 221*a* and is slid inwardly, so that the cover 23*a* is coupled to the case 2*a*. In addition, as shown in FIG. 12, if the cover 23*a* is pulled backward by a distance corresponding to a length of the joint slot 221*a* and then is rotated downward about the tip projection 233*a*, thereby forming a space such that the battery b is separated.

Further, as shown in FIG. 13, when the cover 23*a* is rotated downward, a front side of the battery b having an end accommodated in the battery accommodation part 22*a* is pushed such that a rear side of the battery b is lifted, so the battery b is easily held with the fingers of user. As a result, the battery b can be easily separated from the battery accommodation part 22*a*.

That is, as shown in FIG. 11, the case 2*a* has a semi-circular bulge section 21*a*, which is projected while communicating with a front end of the battery accommodation part 22*a*. Since a semicircular projection 234*a*, which is inserted into the bulge section 21*a*, is formed in the middle of a front side of the cover 23*a*, when a rear end of the cover 23*a* is rotated downward, the semicircular projection 234*a* rotates together with the cover 23*a*, pressing the front end of the battery b.

Embodiment 4

Figure 14:
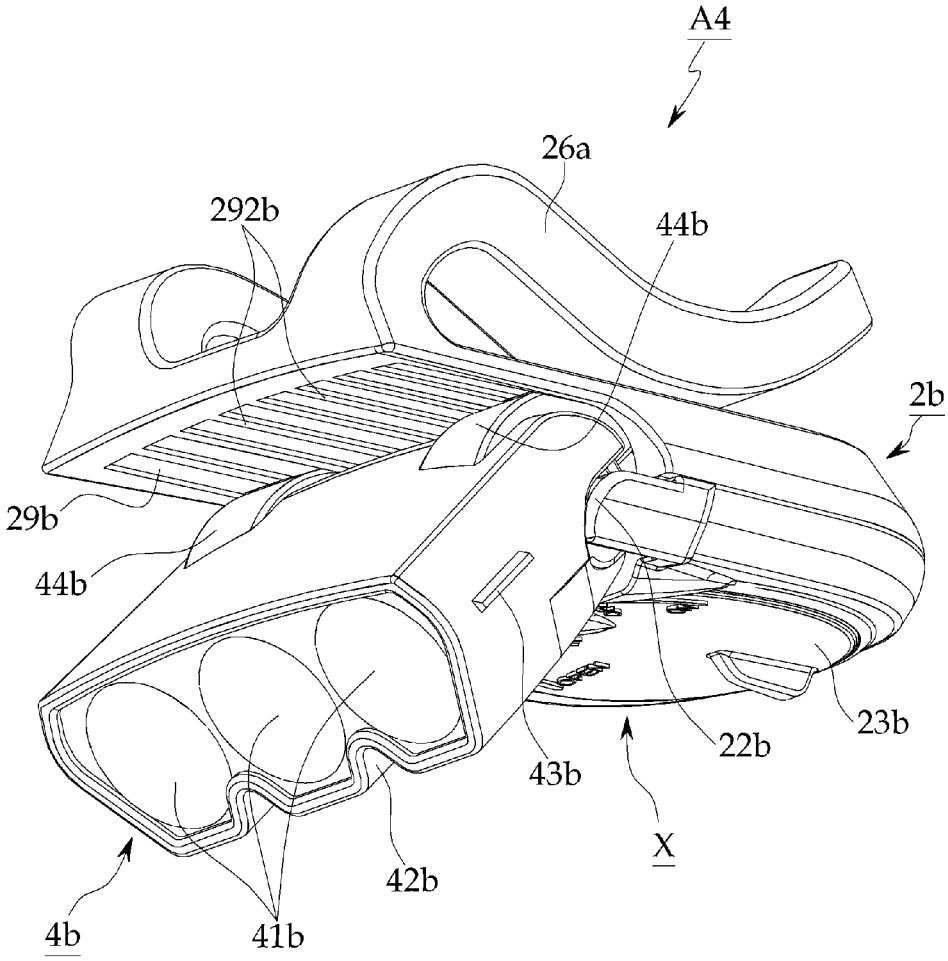
FIG. 14 is a perspective view representing a light emitter to be attached to caps according to the fourth embodiment of the present invention.
Figure 15:
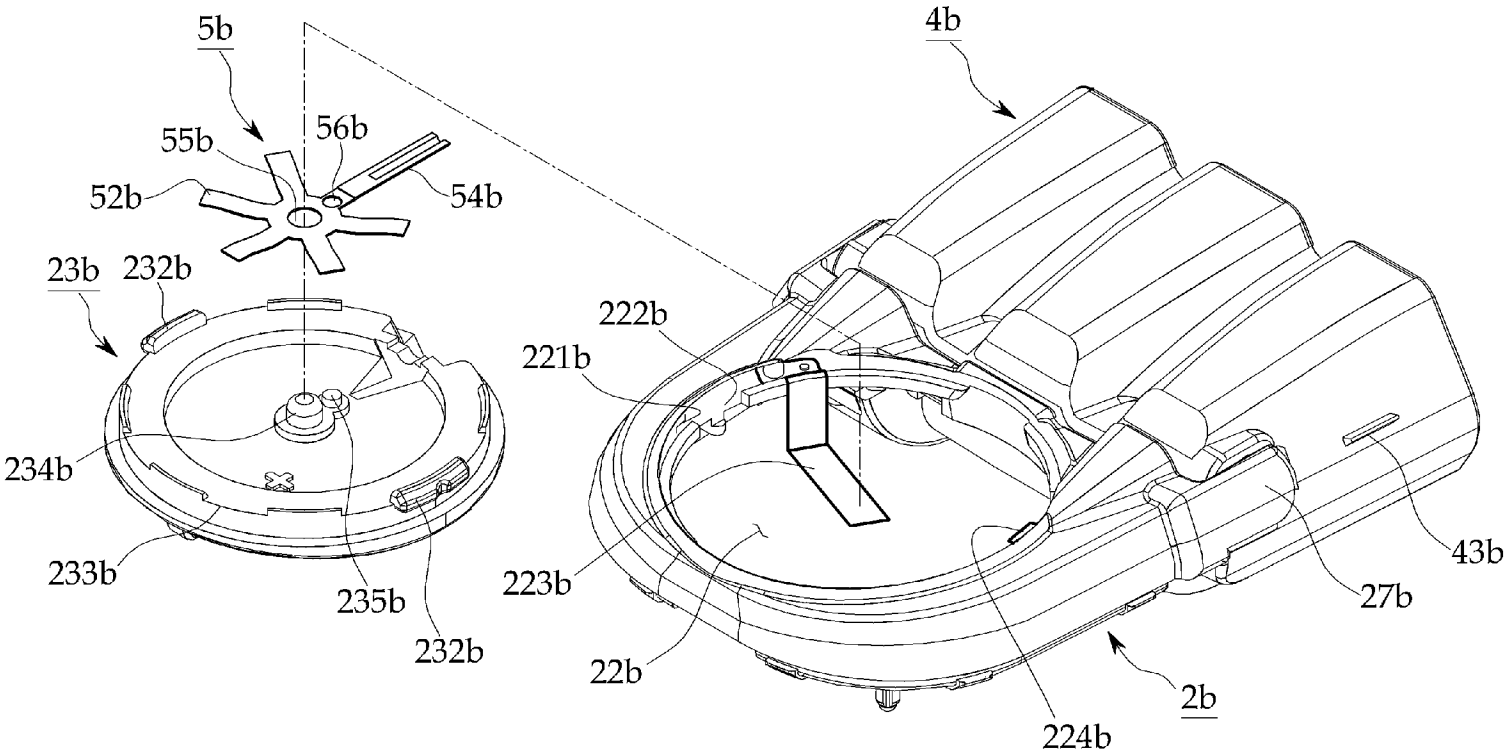
FIG. 15 is a bottom exploded perspective view of the light emitter to be attached to the cap according to the fourth embodiment of the present invention.
Figure 16:
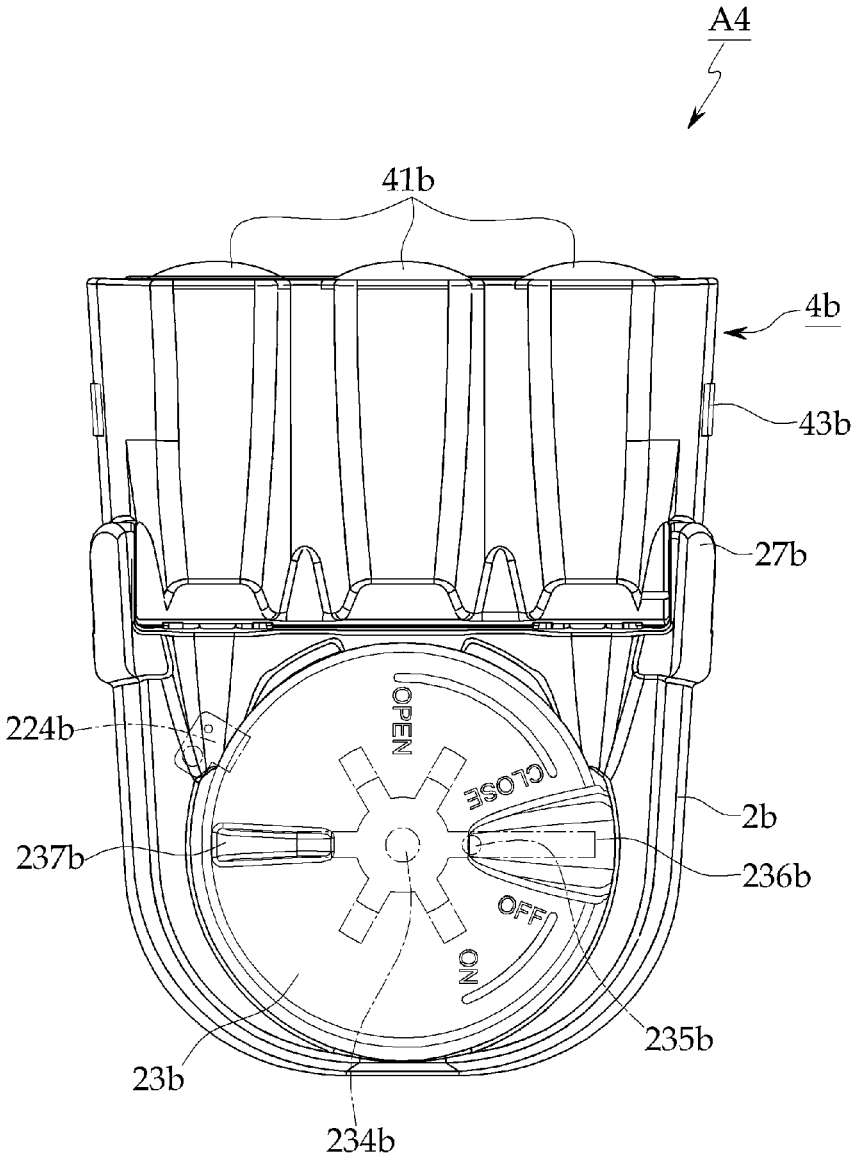
FIGS. 16 to 18 are side views sequentially representing processes for assembling a battery cover and turning on/off the light emitter according to the fourth embodiment of the present invention.
Figure 18:
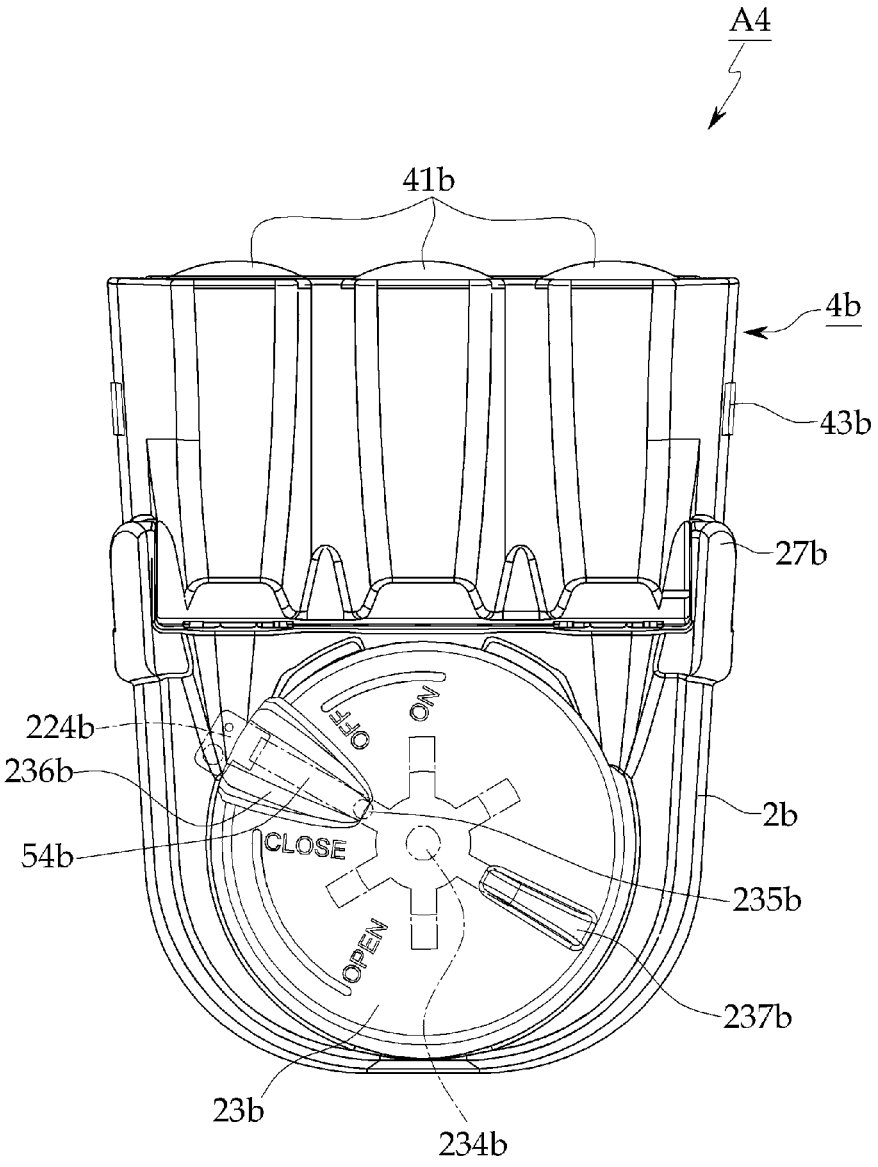

FIG. 14 is a perspective view representing a light emitter to be attached to caps according to the fourth embodiment of the present invention, FIG. 15 is a bottom exploded perspective view of the light emitter to be attached to the cap according to the fourth embodiment of the present invention, and FIGS. 16 and 18 are side views sequentially representing processes for assembling a battery cover and turning on/off the light emitter according to the fourth embodiment of the present invention.

As shown in FIGS. 14 and 15, the light emitter A4 according to the fourth embodiment of the present invention includes a case 2*b* and a sub-body 4*b*. The case 2*b* has a coupling part 29*b*, which is formed at a front side of the case 2*b* and to which a sub-body 4*b* is hinged, a power supply part X formed at a rear side of the case 2*b* to supply power, and a mounting clip 26*b* formed at an outer surface of the case 2*b*. The sub-body 4*b* has at least one first lamp 41*b* mounted on the sub-body 4*b* and is rotatably hinged to the coupling part 29*b*. The power supply part X includes a battery accommodation part 22*b*, which has an upper part having an opening, and a battery cover 23*b*, which is coupled to the opening of the battery accommodation part 22*b* and is rotated to perform on/off functions.

As shown in FIG. 15, the sub-body 4*b* is coupled to the coupling part 29*b* of the case 2*b*. A rear side of the sub-body 4*b* is coupled to a hinge shaft pin 22*b* formed on the coupling part 29*b* such that the sub-body 4*b* is hinged to the case 2*b*.

As shown in FIG. 14, the sub-body 4*b* has a protrusion 43*b*, which is formed at an outer surface thereof such that a user easily catches the sub-body 4*b*. A terminal 44*b* is projected from an upper rear side of the sub-body 4*b* such that the terminal 44*b* makes contact with an inner surface of the coupling part 29*b* of the case 2*b* while producing friction.

The terminal 44*b* is bent in an arc shape and has a hollow, which allows an inter-connection to pass therethrough. A flat part is formed at an outer middle part of the terminal 44*b* to maintain the sub-body 4*b* at a rotation angle of 45 degrees.

A plurality of guide protrusions 292*b* are formed lengthwise along the inner surface of the coupling part 29*b* of the case 2*b* such that the guide protrusions 292*b* make contact with the outer surface the terminal 44*b* and the flat part while producing friction.

Accordingly, if the sub-body 4*b* is rotated, the terminal 44*b* rotates while producing friction against the guide protrusion 292*b* of the coupling part 29*b* of the case 2*b*. The frictional force prevents the sub-body 4*b* from being loosen and allows the sub-body 4*b* to rotate while maintaining proper force. In addition, since the flat part makes contact with the inner surface of the coupling part 29*b*, the sub-body 4*b* maintains an angle of 45 degrees.

The guide protrusions 292*b* formed on the inner surface of the coupling part 29*b* of the case 2*b* reinforces the coupling part 29*b* having a thin plate shape. In addition, the guide protrusions 292*b* reduces the contact area, which is defined when the guide protrusions 292*b* make contact with the terminal 44*b* of the sub-body 4*b*, thereby reducing friction between the sub-body 4*b* and the case 2*b*. Therefore, the life-span of the light emitter can be extended.

That is, if there are no guide protrusions, the terminal 44*b* of the sub-body 4*b* directly makes contact with an inner surface of the coupling part 29*b* of the case 2*b*, so the inner surface of the coupling part 29*b* is damaged due to frequent rotational operations. If the outer surface of the terminal 44*b* is worn, the rotation angle of the sub-body 4*b* cannot be adjusted, so the light emitter must be discarded.

In order to solve such problems, according to the present invention, the guide protrusions 292*b* are further formed, so the life span of the light emitter can be extended due to the guide protrusions 292*b*.

A plurality of linear grooves 42*b* are formed lengthwise along a lower surface of the sub-body 4*b*, thereby ensuring a desired visual field.

Meanwhile, as shown in FIG. 15, the battery accommodation part 22*b* has a circular shape and includes a coupling groove 221*b*, which is formed at an inner circumference of the battery accommodation part 22*b*, insertion grooves 222*b*, which are formed perpendicularly to the coupling groove 221*b* while communicating with the coupling groove 221*b*, a negative contact terminal 223*b* formed at a lower part of the battery accommodation part 22*b*, and a positive contact terminal 224*b* formed in the inner circumference of the battery accommodation part 22*b*.

The battery cover 23*b* is provided in the center of an inner surface with an electrical contact member 5*b*, which makes contact with an anode of the battery. The battery cover 23*b* includes a plurality of electrical contact sections 52*b* and a current terminal 54*b* making contact with the positive contact terminal 224*b*. The battery cover 23*b* is provided at an outer circumference thereof with locking protrusions 232*b* which are inserted into the insertion grooves 222*b*. A locking member 233*b* having an arc shape is formed on the outer circumference of the battery cover 23*b*. The locking protrusion 232*b* is inserted into the insertion groove 222*b* of the battery accommodation part 22*b*, and the locking member 233*b* makes contact with an inner circumference of the coupling groove 221*b*.

Accordingly, the locking protrusion 232*b* is inserted into the insertion groove 222*b* of the battery accommodation part 22*b*, and then the battery cover 23*b* is rotated counterclockwise by 90 degrees such that the locking protrusion 232*b* and the locking member 233*b* rotates while moving along the coupling groove 221*b*, resulting in a locking state.

Two locking protrusions 232*b* are opposite to each other while being spaced apart from each other by an angle 180 degrees.

A central projection shaft 234*b* is formed in the center of the inner surface of the battery cover 23*b* such that the electrical contact member is inserted into the central projection shaft 234*b*. An auxiliary projection shaft 235*b* is further formed at a side of the central projection shaft 234*b*. A central hole 55*b*, into which the central projection shaft 234*b* is inserted, is formed in the center of the electrical contact member 5*b*. An auxiliary insertion hole 56*b*, into which the auxiliary projection hole 235*b* is inserted, is formed at a side of the central hole 55*b*.

Accordingly, if the central projection shaft 234*b* is inserted into the central hole 55*b* of the electrical contact member, and the auxiliary projection shaft 235*b* is inserted into the auxiliary insertion hole 56*b*, the electrical contact member 5*b* is prevented from being rotated or separated, so that the electrical contact member 5*b* is firmly fixed.

As shown in FIG. 16, a handle 236*b* is projected from the outer surface of the battery cover 23*b*, thereby allowing a user to easily manipulate the light emitter. The handle 236*b* has a fan shape, which is getting wider from a center portion to a periphery of the batter cover 23*b*, and is projected upwardly from the battery cover 23*b* while extending beyond an outer diameter of the battery cover 23*b*.

A catching projection 237*b* is projected from the outer surface of the battery cover 23*b* in opposition to the handle 236*b*. In a state that the thumb of the user is engaged with the handle 236*b*, the index finger of the user is engaged with the catching projection 237*b*, thereby allowing the user to easily operate the light emitter.

Hereinafter, the process of coupling the battery cover and on/off operation of power will be described with reference to FIGS. 16 to 18.

As shown in FIG. 16, the battery accommodation part 22*b* is covered with the battery cover 23*b* by fitting the battery cover 23*b* into the battery accommodation part 22*b*. This state will be referred to as 0 degree. At this time, the locking protrusion 232*b* is inserted into the insertion groove 222*b*.

Figure 17:
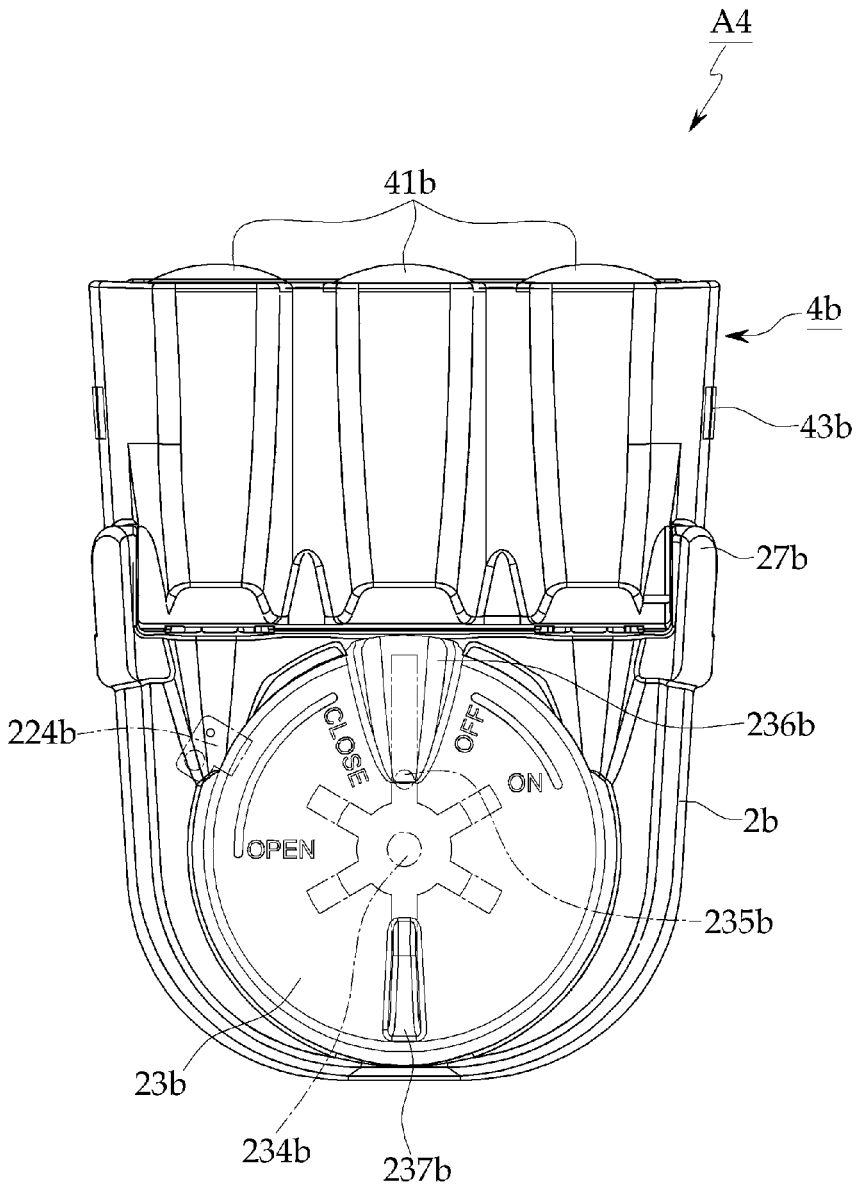

After that, as shown in FIG. 17, the battery cover 23*b* is rotated counterclockwise by 90 degrees, resulting in the locking state. That is, the locking protrusion 232*b* and the locking member 233*b* of the battery cover 23*b* move along the coupling groove 221*b* of the battery accommodation part 22*b*, resulting in the locking state.

As shown in FIG. 18, as the battery cover 23*b* is rotated clockwise by 45 degrees, the current terminal 54*b* makes contact with the positive contact terminal 224*b*. As a result, current flows and power is turned on.

That is, if the battery cover 23*b* is coupled to the battery accommodation part 22*b* and then the battery cover 23*b* is rotated about 135 degrees, power is turned on.

After that, if the battery cover 23*b* is reversely rotated by 45 degrees, the current terminal 54*b* is separated from the positive contact terminal 224*b*, so that the power is turned off and the locking state is released.

According to the fourth embodiment of the present invention, even if the power switch is additionally formed, the battery cover 23*b* serves as a switch, realizing compact and light-weight structure of the light emitter.

As described above, according to the present invention, the user can adjust the distance of radiant light and the amount of radiant light by moving a sub-body equipped with a first lamp back and forth such that the first lamp is independently turned on. In addition, the sub-body is rotatable such that the user can adjust the radiation angle without moving the head of the user. The light emitter is fixed to a pocket to radiate light in the forward direction by arranging the sub-body at a right angle with respect to a case.

In addition, the lighter emitter can be used in sending emergency signal and provides working safety by emitting light toward the feet of the pedestrian.

In addition, an additional switch unit for a first lamp is provided such that the user can adjust the amount of battery consumption.

Although few embodiments of the present invention have been shown and described, it would be appreciated by those skilled in the art that changes may be made in these embodiments without departing from the principles and spirit of the invention, the scope of which is defined in the claims and their equivalents.

INDUSTRIAL APPLICABILITY

The present invention relates to a light emitter to be attached to caps.

The invention claimed is:

1. A light emitter to be attached to caps, the light emitter comprising:

a case having a plurality of second lamps formed at a front surface thereof, a power switch attached to an outer surface of the case, a battery installed inside the case to provide power, a guide groove formed at a center of the case, and a mounting clip formed at the outer surface of the case; and a sub-body having a first lamp at a front surface thereof and being coupled to the guide groove.

2. The light emitter as claimed in claim 1, further comprising a switch unit for controlling on/off operation of the first lamp.

3. The light emitter as claimed in claim 2, wherein the sub-body is provided at an outer surface thereof with a projection which is coupled to a rail groove formed at a side surface of the guide groove such that the sub-body moves back and forth.

4. The light emitter as claimed in claim 3, wherein the switch unit includes a first contact point installed at the rail groove and a second contact point formed on the sub-body.

5. The light emitter as claimed in claim 1, wherein the sub-body has a rotation part at a side thereof to adjust a rotation angle of the sub-body.

6. The light emitter as claimed in claim 5, wherein the rotation part includes a first gear formed at a rear side of the sub-body and a second gear engaged with the first gear.

7. The light emitter as claimed in claim 5, wherein the rotation part is provided with a brightness adjustment member for adjusting brightness according to the rotation angle of rotation part.

8. The light emitter as claimed in claim 7, wherein the brightness adjustment member has a multi-contact structure.

9. The light emitter as claimed in claim 1, wherein the sub-body further includes an auxiliary battery.

10. The light emitter as claimed in claim 2, wherein the switch unit includes:

a positive terminal and at least one negative terminal electrically connected to the battery; and a negative plate and at least one positive plate formed on the sub-body.

11. The light emitter as claimed in claim 1, wherein the sub-body is further provided with a fixing member for maintaining the sub-body in an advanced state.

12. The light emitter as claimed in claim 11, wherein the fixing member includes a protruding member formed at both sides of the second gear and a recess formed at both sides of a front part of the guide groove corresponding to the protruding member.

13. The light emitter as claimed in claim 5, wherein the rotation part includes a groove formed at a rear side of the sub-body and an elastic protrusion inserted into the groove.

14. The light emitter as claimed in claim 13, wherein the groove formed at the rear side of the sub-body includes a fixing groove, a first groove, a second groove and a third groove, and the elastic protrusion is inserted into the fixing groove and the first to third grooves to fix a position of the sub-body.

15. The light emitter as claimed in claim 14, wherein the first groove is formed on an upper horizontal surface of the rear side of the sub-body, the fixing groove is formed at a front side of the first groove, the second groove is formed at a connection part of the upper horizontal surface of the sub-body and a curved surface part of a rear end of the sub-body, and the third groove is formed at a center of the curved surface part of the rear end of the sub-body.

16. A light emitter to be attached to caps, the light emitter comprising:

a case having a fixed lighting part, which is formed at a front side of the case and is equipped with a second lamp, a power switch formed at an outer surface of the case, a power supply part formed at a rear side of the case to provide power, and a mounting clip formed at the outer surface of the case; and a sub-body, which is provided with a first lamp and is coupled to a side of the fixed lighting part, and which moves back and forth to turn on/off the first lamp and is rotated.

17. The light emitter as claimed in claim 16, wherein the sub-body has a rotation part formed at a side of the sub-body such that an angle of the sub-body is adjusted, in which the rotation part includes a guide groove formed in the case and a projection which is formed at a side of the sub-body and is coupled to the guide groove such that the sub-body is rotated.

18. The light emitter as claimed in claim 17, wherein the guide groove includes a horizontal part having a predetermined length and a curved part which is connected to the horizontal part and is bent in an arc-shape, in which a recess is formed at a lower part of the horizontal part such that the projection is locked with the recess.

19. The light emitter as claimed in claim 18, wherein a plurality of studs making contact with the projection are formed in the guide groove such that the sub-body is fixed in various angular positions.

20. The light emitter as claimed in claim 19, wherein the studs include first to third studs, in which the first stud is formed on the horizontal part to maintain a state in which the projection is withdrawn from a recess and then moves forward along the horizontal part, the second stud is formed in a middle of the curved part to maintain a state in which the projection rotates downward by about 45 degrees, and the third stud is formed at an end of the curved part to maintain a state in which the projection rotates by 90 degrees.

21. The light emitter as claimed in claim 16, wherein the sub-body further includes a brightness adjustment member to adjust brightness according to a rotation angle of the sub-body.

22. The light emitter as claimed in claim 16, wherein the power supply part includes a battery accommodation part formed at an inner rear side of the case and a cover, which is coupled to the battery accommodation part and opens/closes the accommodation part in such a manner that a battery b can he replaced without completely separating the battery accommodation part.

23. The light emitter as claimed in claim 22, wherein the battery accommodation part includes positive and negative contact terminals, which are formed at an inner upper part and an inner lower part of the battery accommodation part and make contact with the battery, respectively, and a joint slot to couple the cover to both sides of the battery accommodation part.

24. The light emitter as claimed in claim 22, wherein the case has a semicircular bulge section, which is projected while communicating with a front end of the battery accommodation part, and a leading part having a tip projection is formed at front both ends of the cover in a predetermined length, and a semicircular projection is formed in a front middle part of the cover and is inserted into the bulge section, wherein, if a rear end of the cover is rotated upward, the semicircular projection is rotated downward such that the battery is lowered.

25. A light emitter to be attached to caps, the light emitter comprising:

a case; and a sub-body, wherein the case includes a coupling part, which is formed at a front side of the case and to which the sub-body is hinged, a power supply part formed at a rear side of the case to supply power and a mounting clip formed at an outer surface of the case, the sub-body has a first lamp mounted thereon and is hinged to the coupling part, the power supply part includes a battery accommodation part, which has an upper part having an opening, and a battery cover, which is coupled to the opening of the battery accommodation part and is rotated to perform on/off functions.

26. The light emitter as claimed in claim 25, wherein the battery accommodation part has a circular shape and includes a coupling groove, which is formed at an inner circumference of the battery accommodation part, an insertion groove, which is formed perpendicularly to the coupling groove while communicating with the coupling groove, a negative contact terminal formed at a lower part of the battery accommodation part, and a positive contact terminal formed in the inner circumference of the battery accommodation part, wherein the battery cover is provided in a center of an inner surface with an electrical contact member, which makes contact with an anode of a battery and includes a plurality of electrical contact sections and a current terminal making contact with the positive contact terminal, in which the battery cover is provided at an outer circumference thereof with a locking protrusion which is inserted into the insertion groove.

27. The light emitter as claimed in claim 26, wherein the current terminal makes contact with the positive contact terminal as the battery cover is rotated in a predetermined direction, thereby activating electrical current so that the first lamp is turned on, and the contact terminal is separated from the positive contact terminal as the battery cover is reversely rotated, resulting in a locking state and turning off the first lamp.

28. The light emitter as claimed in claim 26, wherein a central projection shaft is formed in the center of the inner surface of the battery cover and an auxiliary projection shaft is formed at a side of the central projection shaft, and wherein a central hole, into which the central projection shaft is inserted, is formed in a middle part of the electrical contact member, and an auxiliary insertion hole, into which the auxiliary projection hole is inserted, is formed at a side of the central hole.

29. The light emitter as claimed in claim 28, wherein a handle and a catching projection are projected from an outer surface of the battery cover, thereby providing easy operation of the light emitter, and wherein the handle has is a fan shape, which is getting wider from a center portion to a periphery of the batter cover, and is projected upwardly from the battery cover while extending beyond an outer diameter of the battery cover.

30. The light emitter as claimed in claim 25, wherein the sub-body is provided at an outer surface thereof with a protrusion, which allows a user to easily catch the light emitter, and a terminal, which makes contact with an inner surface of the coupling part of the case while producing friction, and wherein the terminal is bent in an arc shape and has a hollow, which allows an interconnection to pass therethrough, and a flat part, which is formed at an outer middle part of the terminal to maintain a rotation angle of the sub-body.

31. The light emitter as claimed in claim 25, wherein a plurality of guide protrusions are formed lengthwise along the inner surface of the coupling part of the case such that the guide protrusions make contact with the terminal while producing friction.

32. The light emitter as claimed in claim 30, wherein a plurality of linear grooves are formed lengthwise along a lower surface of the sub-body, thereby ensuring a desired visual field.

33. The light emitter as claimed in claim 2, wherein the sub-body has a rotation part at a side thereof to adjust a rotation angle of the sub-body.

34. The light emitter as claimed in claim 33, wherein the rotation part includes a first gear formed at a rear side of the sub-body and a second gear engaged with the first gear.

35. The light emitter as claimed in claim 33, wherein the rotation part is provided with a brightness adjustment member for adjusting brightness according to the rotation angle of rotation part.

36. The light emitter as claimed in claim 35, wherein the brightness adjustment member has a multi-contact structure.

37. The light emitter as claimed in claim 33, wherein the rotation part includes a groove formed at a rear side of the sub-body and an elastic protrusion inserted into the groove.

38. The light emitter as claimed in claim 37, wherein the groove formed at the rear side of the sub-body includes a fixing groove, a first groove, a second groove and a third groove, and the elastic protrusion is inserted into the fixing groove and the first to third grooves to fix a position of the sub-body.

39. The light emitter as claimed in claim 38, wherein the first groove is formed on an upper horizontal surface of the rear side of the sub-body, the fixing groove is formed at a front side of the first groove, the second groove is formed at a connection part of the upper horizontal surface of the sub-body and a curved surface part of a rear end of the sub-body, and the third groove is formed at a center of the curved surface part of the rear end of the sub-body.

* * * * *